United States Patent [19]

Cain et al.

[11] 4,147,594

[45] Apr. 3, 1979

[54] ONE-SPOT CYLINDRICAL COKE QUENCHING CAR AND QUENCHING METHOD

[75] Inventors: George R. Cain, Pittsburgh; Ward F. Gidick, West Newton; William D. Edgar, Allison Park, all of Pa.

[73] Assignee: Koppers Company, Inc., Pittsburgh, Pa.

[21] Appl. No.: 785,366

[22] Filed: Apr. 7, 1977

[51] Int. Cl.[2] ..... C10B 33/00; C10B 39/10

[52] U.S. Cl. ..... 201/39; 202/227; 202/263

[58] Field of Search ..... 202/227, 228, 229, 230, 202/262, 263; 201/39

[56] References Cited

U.S. PATENT DOCUMENTS

| | | | |
|---|---|---|---|
| 1,421,445 | 7/1922 | Frankel | 202/227 |
| 2,785,115 | 3/1957 | Borch | 202/227 X |
| 3,367,844 | 2/1968 | Cremer | 202/227 |
| 3,780,888 | 12/1973 | Hoffman | 202/227 X |
| 3,840,436 | 10/1974 | Lorrek | 202/263 |
| 4,010,081 | 3/1977 | Martt | 202/263 X |

*Primary Examiner*—Morris O. Wolk
*Assistant Examiner*—Arnold Turk
*Attorney, Agent, or Firm*—R. Lawrence Sahr; Oscar B. Brumback

[57] ABSTRACT

A cylindrical drum having a lining spaced apart from the shell of the drum is rotatably mounted on a frame movable on rails along the coke side of a coke oven battery. A fume shield is fixed to the frame and covers openings in the shell and lining through which hot coke passes, when pushed from a coke oven chamber. A hood is fixed to the structure supporting a coke guide and has a movable portion that coacts with the rotatable shell when coke gravitates into the shell. The drum is rotatable to several operative positions.

19 Claims, 14 Drawing Figures

ONE-SPOT CYLINDRICAL COKE QUENCHING CAR AND QUENCHING METHOD

BACKGROUND OF THE INVENTION

1. Field of the Invention

The invention pertains to coke oven batteries generally and more particularly to apparatus for catching and transporting hot coke after it is pushed from a chamber of the coke oven battery.

2. Description of the Prior Art

A coke oven battery comprises a series of side-by-side coking chambers that extend transversely from the common front line of the battery. Conventionally, tracks extend parallel with the battery for carrying the coke that is produced away from the battery. Thus the coke that is produced in the coke oven battery is discharged from the coking chamber at the discharge side, by way of a conventional coke guide, is fed to a coke receiving car on the tracks.

The coke discharged from the coking chamber is in a glowing state. The coke is quenched or cooled rapidly, usually by water, to prevent oxidation of the coke.

Large amounts of dust and smoke tend to be produced when the coke is discharged from the coking chamber and large amount of steam tend to be produced (and to entrain small particles of coke) when the coke is quenched. Efforts have been made to prevent the dust, smoke and particles from entering the ambient atmosphere and from creating pollution problems.

The coke receivers or cars have generally been of rectangular or box-like configuration. Attempts have been made to develop cars having a coke receiver that is drum-like in configuration. Johannes Lorrek, U.S. Pat. No. 3,840,436, "Apparatus For Receiving Coke Pushed From Horizontal Coke Ovens," describes a movable vehicle that supports a drum-like receiver for the coke; the drum has an axis that is parallel to the axis of the coking chamber but perpendicular to the coke oven battery and the line of travel of the vehicle on the tracks. Walter Cremer, U.S. Pat. No. 3,367,844, "Apparatus For Quenching Coke From Horizontal Coke Ovens," describes a drum-like receiver that has an axis that is parallel to the line of the coke oven battery and the line of travel of the vehicle on the tracks but is perpendicular to the axis of the coking chambers.

The foregoing patents describe apparatus that is complex and expensive. Each has a self-contained housing that removes dust and particles and each has its own spray system, within the drum, for quenching the coke. U.S. Pat. No. 3,840,436 utilizes lifting units operable upon the rotation of the drum for discharging the coke, and U.S. Pat. No. 3,367,844 shows the axis of the drum inclined with respect to the vehicle's line of travel with rotation of the drum moving the coke from a receiving end of the drum to a discharge end.

The present invention provides a simple car having a drum whose axis is parallel with the line of travel of the car and parallel with the horizon. The drum rotates through a limited arc. The receiver is operable with conventional gas and dust removal equipment, quenching stations and coke wharfs.

SUMMARY OF THE INVENTION

Apparatus for receiving hot coke pushed from a coking chamber of a coke oven battery, and transporting the coke to a quenching station and a coke wharf, comprises a rotatable tubular vessel having closed ends and an opening in the shell of the vessel for receiving hot coke. A geometric chord-like means is provided in the vessel for supporting coke therein disposed adjacent the coke receiver opening. The vessel is mounted on an elongated vehicle that is movable along the coke side of the battery. Means is provided on the vehicle for rotating the vessel. A fume hood is mounted to the vehicle and surrounds a portion of the vessel. The shell contains openings for admitting a coke cooling fluid and for discharging liquid coke cooling fluid from the vessel.

For a further understanding of the invention and for features and advantages thereof, reference may be made to the following description and the drawings which illustrate a preferred embodiment of equipment in accordance with the invention which is suitable for practicing the method of the invention.

DETAILED DESCRIPTION

Figure 1:
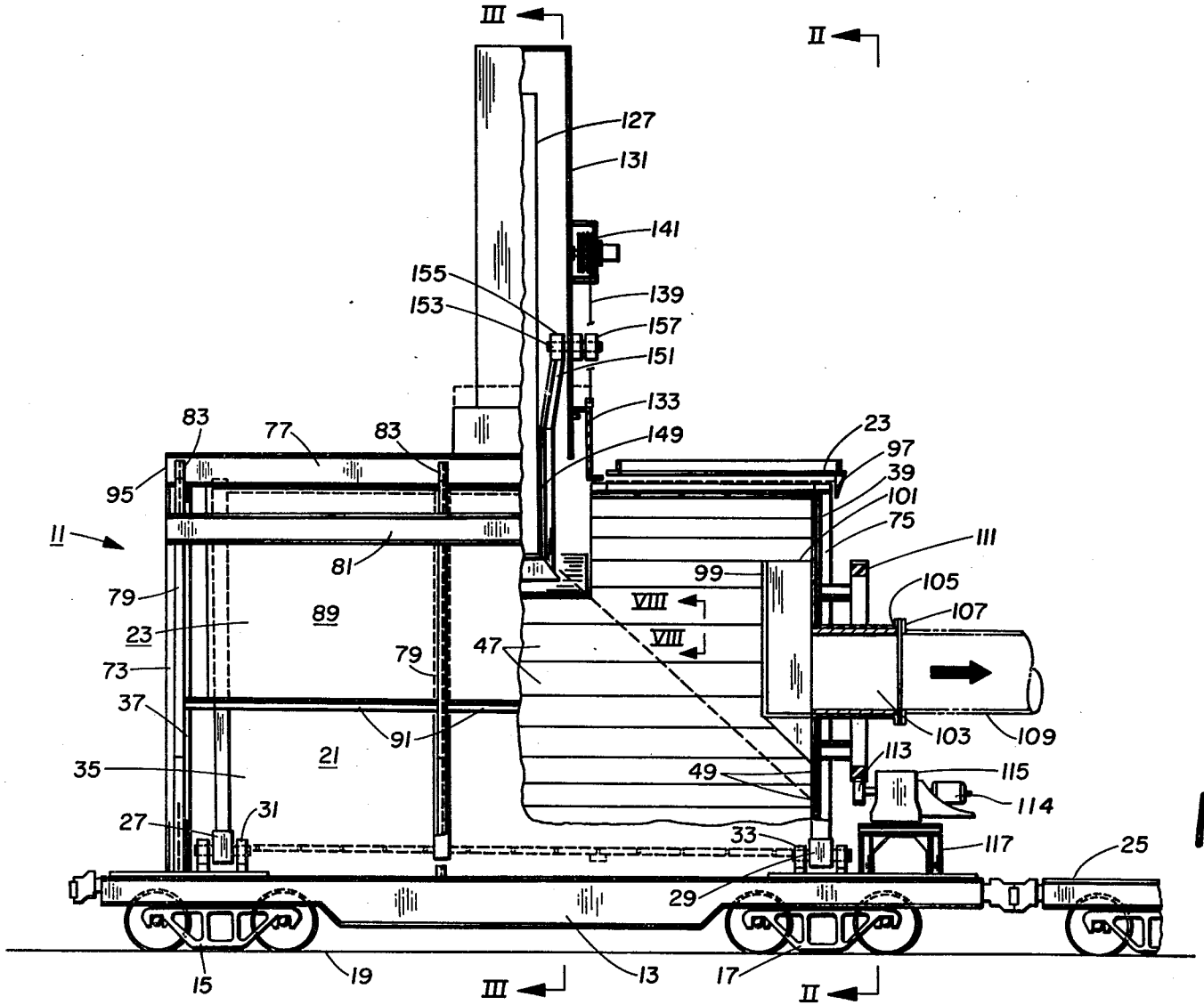
FIG. 1 is a schematic elevational view of a preferred embodiment of the coke quenching car, partly cut away, in accordance with the present invention.

Referring to FIG. 1, a rotatable cylindrical coke quenching car 11 in accordance with the present invention includes an elongated flat-bed frame 13 mounted to front 15 and rear 17 wheeled trucks that travel on rails 19. The rails 19 run parallel the line of a coke battery 121; the axis of individual chambers 119 are normal the line of travel of the frame 13. A rotatable cylindrical drum 21 is mounted on the flat-bed frame 13 with its axis parallel to the line of travel of the frame 13 and parallel with the horizon. A fume shield 23 is mounted to the frame 13 and partly surrounds a portion of the drum 21.

The frame 13, and thus the coke quenching car 11, generally is coupled to and moves with a traction car 25 which is conventional in construction, and on which are located conventional gas cleaning apparatus (not shown).

The drum 21 rotates through an arc relative to the flat-bed frame 13. To this end, at the front and rear end portions of the flat-bed frame 13, there are spaced apart support rollers 27, 29 that are journaled to bearing supports 31, 33 fixed to the flat-bed frame 13. These rollers 27 and 29 support the rotatable cylindrical drum 21. The drum 21 comprises a cylindrical hollow shell 35 and solid end plates 37, 39. The hollow shell 35 has two rectangular openings 41, 43 (see FIGS. 4–7) for receiving cooling liquid for quenching the coke, to allow the exit of the resulting steam, and to allow for the discharge of cooled coke at a coke wharf 169. Openings 41 and 43 are arranged axially on opposite sides of a larger rectangular opening 45 that receives the coke from the coke oven 119. All of the openings 41, 43 and 45 provide an exit for steam during the quench and, also, for the discharge of cooled coke at the coke wharf 169.

Figure 8:
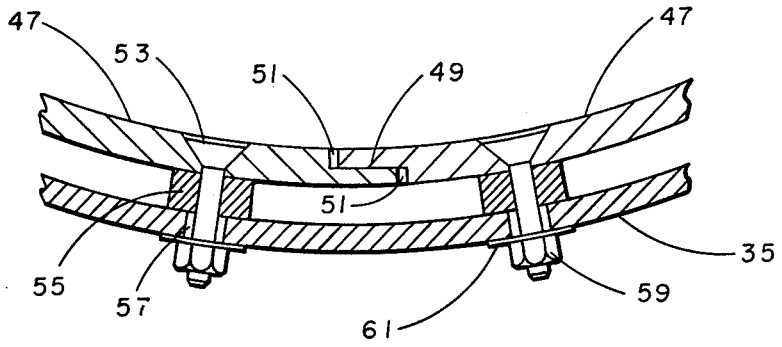
FIG. 8 is a view of a typical joint between adjacent liner plates within the cylindrical shell, and is a view along line VIII—VIII of FIG. 1.

The interior of the drum is subjected to large temperature differentials. The inner surface of the hollow cylindrical shell 35, and the inner surface of each end plate 37, 39 is lined, respectively, with a plurality of metallic liner plates 47 on the shell and 49 on the end plates. FIG. 8 illustrates a typical joint between two adjacent shell liner plates 47, and those skilled in the art will understand that a similar type of joint exists between adjacent end liner plates 49. The edge 51 of each liner plate 47 is scarfed so that the plates overlap, leaving a gap between the overlapping plates to allow for thermal expansion. Adjacent each scarfed edge 51, there is a countersunk bolt 53 that extends through a spacer 55 and through an oversize hole 57 in the cylindrical shell 35. A nut 59 is threaded onto the end of the bolt 53, and a washer 61 is disposed between the nut 59 and the shell 35. Thus, because of the oversize hole 57 in the cylindrical shell 35, the shell liner plates 47, and end liner plates 49 also, can expand and contract thermally.

Figure 9:
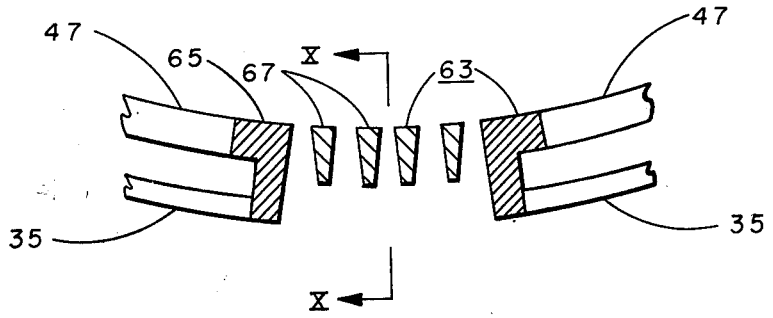
FIG. 9 is a view along line IX—IX of FIG. 10 of a drainage frame in the cylindrical shell.
Figure 10:
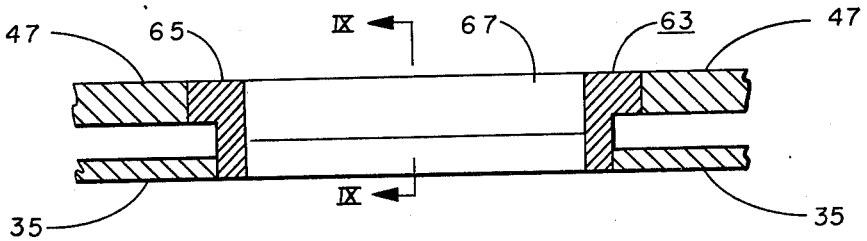
FIG. 10 is a view along line X—X of FIG. 9 of the drainage frame shown therein.

At the quenching station (not shown) an excess of water is used to cool the coke. Thus, not all the water is converted to steam. FIGS. 9 and 10 illustrate schematically one of a plurality of drainage frames 63 in the liner plates 47 and cylindrical shell 35. In practice there may be several such drainage screen openings 63 arranged in axial alignment parallel to the longitudinal axis of the cylindrical shell 35. The drainage frame 63 comprises a rectangular cast frame 65 to which are integrally connected a plurality of longitudinally arranged, spaced apart, grate-type bars 67. The cast frame 65 is secured, as by fastening or in any other suitable manner, to the liner plates 47 and to the outer shell 35. As shown in FIG. *6a*, the drainage frames 63 are located almost diametrically opposite the rectangular openings 41 and 43 in the cylindrical shell 35 and liner plates 47.

Figure 3:
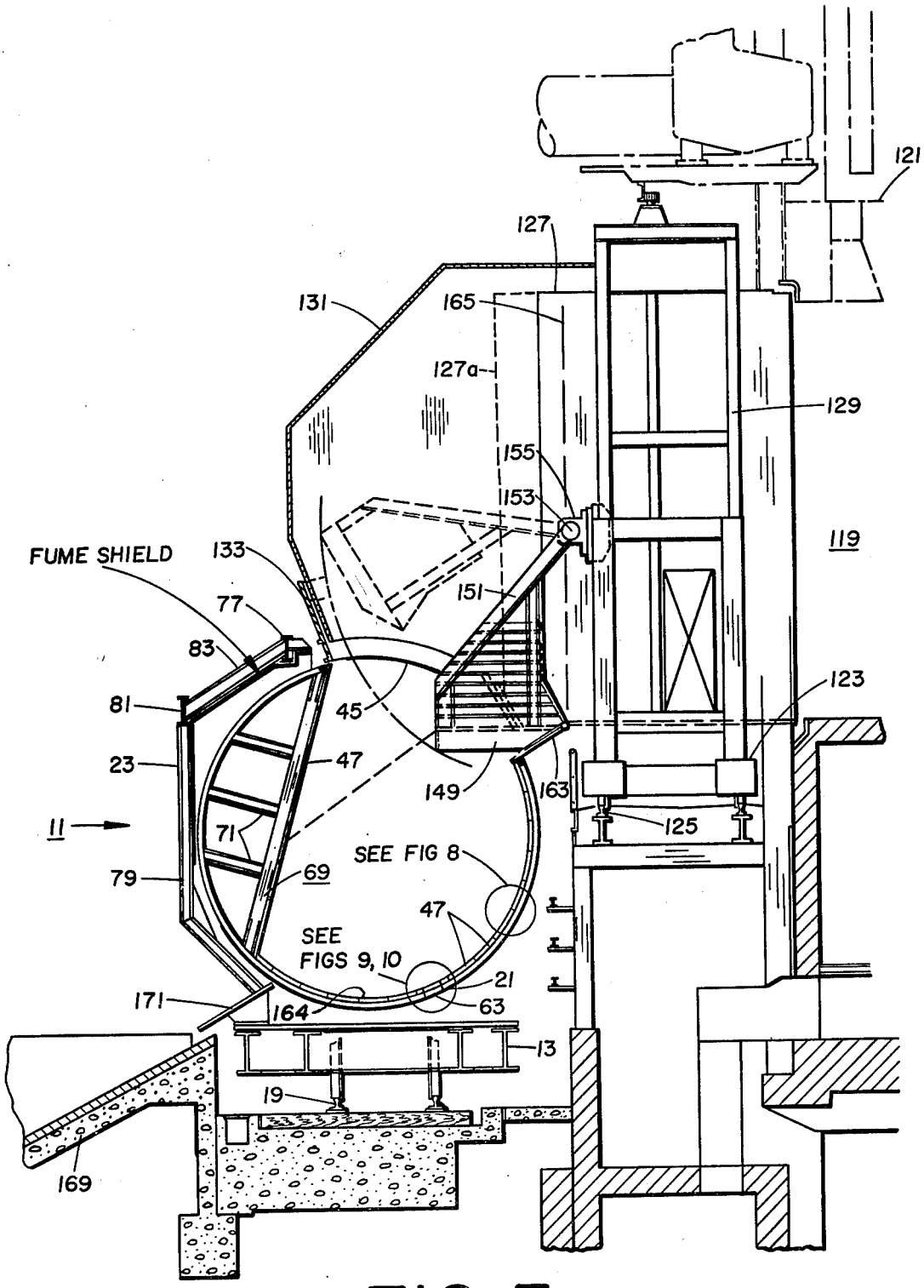
FIG. 3 is a view along line III—III of FIG. 1.

Referring to FIG. 3, a planar bottom 69 is provided within the cylindrical shell 35 to increase the movement of the coke upon the rotation of the shell 35. As a result of this movement, the depth of the coke pile in the drum 21 is reduced, the layer of coke tends to be uniform in depth along the length of the shell 35 so the quenching at the quenching station (not shown) can be faster and more uniform and therefore more complete. The planar bottom 69 is supported therein by struts 71 and held in geometric chord-like manner in the shell 35. The planar bottom 69 is also covered with liner plates 47, like those described heretofore. The planar bottom 69 is disposed about as shown in FIG. 3 (not to scale) relative to the opening 45, which is at an angle of about 105° from the secant that defines the arc of the opening 45.

Figure 2:
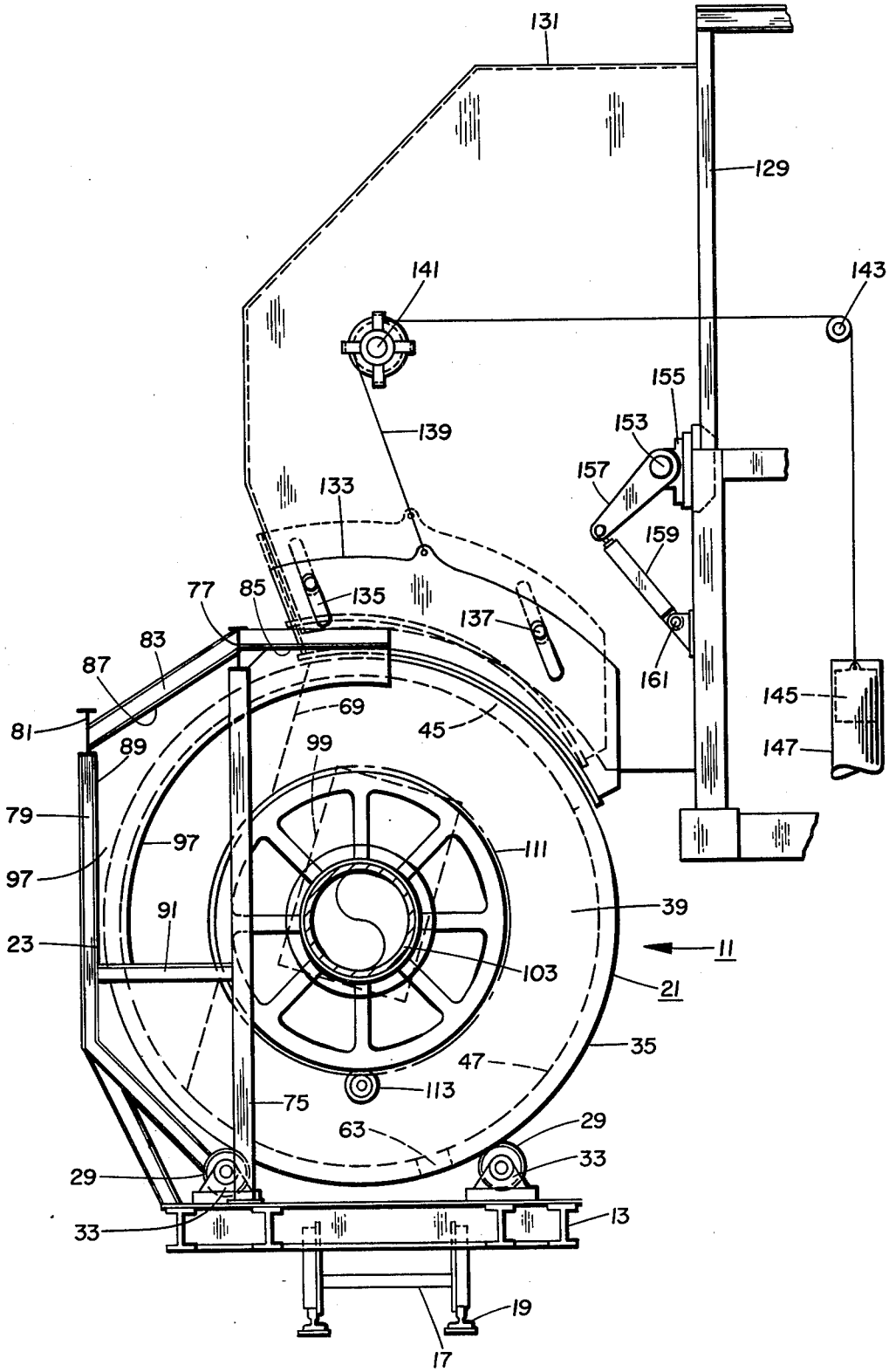
FIG. 2 is a view along line II—II of FIG. 1 showing one end of the car of FIG. 1.

The frame shield 23 covers the openings 41, 43 and 45 during the time in which the car 11 is transporting the coke to the quenching station (not shown) and the coke wharf (not shown). The fume shield 23 is mounted to the frame 13, referring to FIGS. 1 and 2, by a pair of vertical stanchions 73, 75 that are fixed to the flat-bed frame 13 adjacent the ends thereof and near the left-hand longitudinal edge (as viewed in FIG. 2). The stanchions 73, 75 are fixed at their top ends to a longitudinally extending beam 77 which may be a conventional I-beam is suggested. Intermediate the ends of the longitudinally extending beam 77 is one or more bent support columns 79. These bent support columns 79 are secured at their bottom ends to the flat-bed frame 13, and at their top ends to a longitudinally extending beam 81, arranged in spaced apart, parallel relation to the beam 77. The beam 81 is preferably an I-beam. Between the parallel I-beams 77, 81 are intercostal I-beams 83, as shown in FIGS. 1 and 2. One metallic sheet 85 of the fume shield 23 is disposed horizontally, as shown in FIG. 2. Another metallic sheet 87 is disposed angularly between the I-beams 77, 81 and is secured to the intercostal I-beams 83. Another metallic sheet 89 is disposed vertically and is supported by the vertical upper portion of the bent columns 79. The vertical metallic sheet terminates at a horizontally disposed angle 91 extending intercostally between the bent columns 79, as shown in FIG. 1. The end pieces 93, 95 that connect to the several metallic sheets 85, 87, 89 are supported by the vertical stanchion 75 and the bent stanchion 79 at the ends of the fume shield 23. As shown in FIG. 2, the end pieces have an arcuate edge 97 that is concentric with the cylindrical drum 21.

To remove gases and dust from inside the drum 21, the drum 21 is fitted internally with a rectangular shaped exhaust duct 99 that has an open top 101 and is mounted to the inner surface of the end plate 39. The exhaust duct 99 communicates with a horizontal cylindrical tubular exhaust duct 103 that extends outwardly from the end plate 39 in axial alignment with the cylindrical drum 21. The horizontal cylindrical tubular exhaust duct 103 has a flanged end 105 that coacts with a flanged end 107 of a duct 109 carrying dirty gases from the coke quenching car 11 to the gas cleaning and scrubbing apparatus (not shown) on the traction car 25.

To rotate the drum 21 relative to the bed 13, a large bull gear 111 is mounted externally and fixedly to the end plate 39 of the shell 35. The bull gear 111 is driven by a coacting pinion 113 on the end of the output shaft of an electric motor 114 and speed reducer 115 that is mounted on a support structure 117 attached to the flat-bed frame 13 about where shown in FIG. 1.

The coke receiving car 11 of the present invention operates with conventional equipment that has conventionally associated with coke ovens. Referring to FIG. 3, the coke quenching car 11 is shown at an operative position to receive the coke that is to be pushed from chamber 119 of a coke oven battery 121. As shown, a conventional coke guide car 123 travels on rails 125, and a coke guide 127 is carried on the coke guide car 123. The coke guide 127 is supported by structure 129 on the car 123 so that the coke guide 127 can be racked in and out in a conventional manner. This coke guide car 123 carries a fume hood 131 that extends outwardly over the coke quenching car, as shown in FIGS. 2 and 3. As shown in FIG. 2, the fixed fume hood 131 carries at its bottom a movable hood portion 133 that is provided with elongate slots 135. Pins 137 fixed to the side of the fixed hood 131 coact with the slots and guide the movable hood portion 133 from the operative position shown in solid outline to the inoperative position shown in dotted outline. The movable hood portion 133 is actuated by a wire rope 139 secured to it, and the wire rope 139 cooperates with an hydraulic rotary actuator 141, mounted onto the side of the fixed hood 131. The wire rope 139 passes over a pulley 143 mounted to the coke guide supporting structure 129 and is connected to a counterweight 145 operating in a tubular conduit 147.

Referring to FIG. 3, a pivotable coke distributor trough 149 is provided. Advantageously, the distributor is of the type shown and described in U.S. Pat. No. 4,053,068 to which patent reference should be made for for further details. The distributor trough 149 is supported on arms 151 that carry a shaft 153 that is journaled in bearings 155 mounted to the coke guide supporting structure 129. Shaft 153, of FIG. 2, carries a crank 157 fixed thereto that is pin-connected to the piston rod portion of a cylinder-piston assembly 159. The cylinder-piston assembly 159 is pivotally mounted, as at 161, to the coke guide supporting structure 129.

Figure 4:
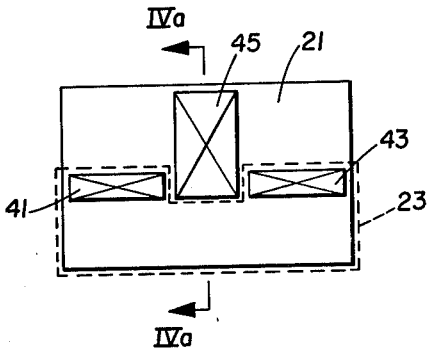
FIGS. 4 and 4*a* are schematic views of the car of FIG. 1 in a first operative position.
Figure 4A:
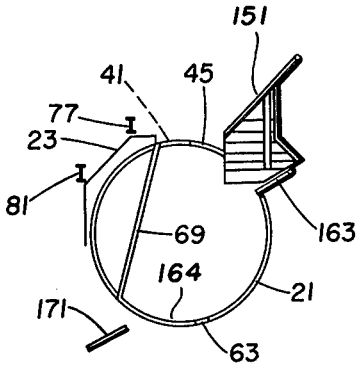

Now referring to FIGS. 3, 4–7 and 4a–7a inclusive, one skilled in the art will understand the operation of the coke quenching car to be:

The traction car 25 moves the coke quenching car 11 to and spots it at oven chamber 119 which is ready to be pushed. The longitudinal axis of the drum 21 is perpendicular to the longitudinal axis of the oven chamber 119. As shown in FIGS. 3, 4 and 4a, the coke guide 127 is racked toward the face of the oven chamber 119 from the extended position 127a, shown in dotted outline, and the coke distributor trough 149 is pivoted downwardly from the position shown in dotted outline to the position 127 shown in solid outline. The trough 149 fits into the large rectangular opening 45 in the cylindrical shell 21. A pivoting tailgate 163 is mounted to the coke guide 127, and the tailgate 163 pivots downward from the inoperative position, shown in dotted outline in FIG. 3 to the solid outline position. When the movable portion 133 of the hood is lowered to coact with the cylindrical shell 21, it is ready to receive hot coke.

As the pusher machine extends the pusher ram into and through the oven chamber, the coke passes through the coke guide 127 and through the distributor trough 149 through opening 45 and gravitates into the cylindrical drum 21. As the coke gravitates into the cylindrical drum 21, the gas cleaning apparatus on the traction car is actuated to induce a flow of gases and fumes from the cylindrical drum through the exhaust duct and the duct 109. When the pushing is completed, the distributor trough 149 is raised to the position shown in dotted outline in FIG. 3 and in FIG. 5a and the face of the pusher ram, which is about at the line 165, shown in FIG. 3, is retracted. Then, the coke guide 127 is racked away from the face of the oven chamber to the position 127a and the tailgate 163 is raised.

Motor 114 is now actuated to drive the bull gear 111. The cylindrical shell is rotated counterclockwise, as viewed in FIGS. 2 and 3, to the position shown in FIG. 5a. The openings 41, 43 and 45 in the shell are now covered by the fume shield 23 and the movable hood portion is raised. The coke quenching car 11 is now ready to travel to a conventional coke quenching station (not shown).

It will now be recognized that as the cylindrical drum 21 rotates counterclockwise, the piled chunks of hot coke in the drum 21 move from the arcuate position 164 of the drum 21 to the planar bottom 69. The coke tends to level itself and form a layer of uniform depth.

Figure 5:
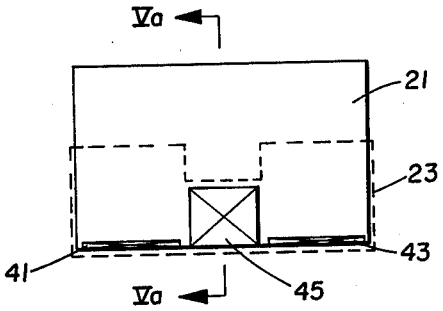
FIGS. 5 and 5*a* are schematic views of the car of FIG. 1 in a second operative position.
Figure 5A:
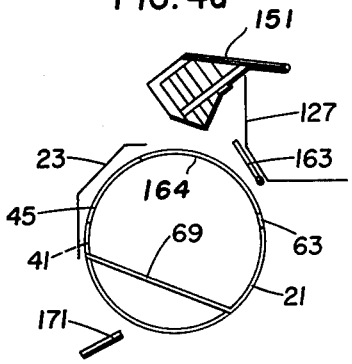
Figure 6:
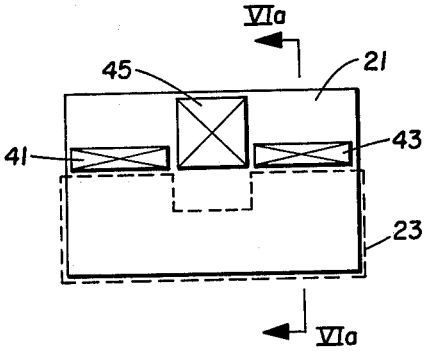
FIGS. 6 and 6*a* are schematic views of the car of FIG. 1 in a third operative position.
Figure 6A:
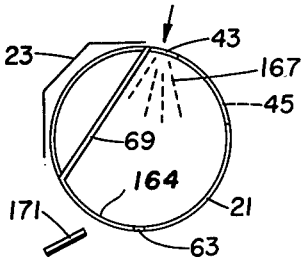

When the coke quenching car reaches the quenching station (not shown), motor 114 is again actuated and the cylindrical drum 21 is rotated clockwise, as viewed in FIGS. 2, 3 and 5a, to bring the openings 41, 43 and 45 to the position shown in FIGS. 6 and 6a. Again, those skilled in the art will recognize that as the cylindrical drum 21 rotates, the coke in the drum 21 slides from the planar bottom 69 onto the arcuate portion 164 and tends further to achieve a level load condition. The water at the coke quenching station (not shown) is turned on and, as shown in FIG. 6a, the coke is quenched by that quenching station water sprays or streams 167 directed onto the coke through the openings 41, 43 and 45. The water drains from the cylindrical drum 21 through the plurality of drainage frames 63 and is conducted by conduits (not shown) to a sump of conventional construction.

Figure 7:
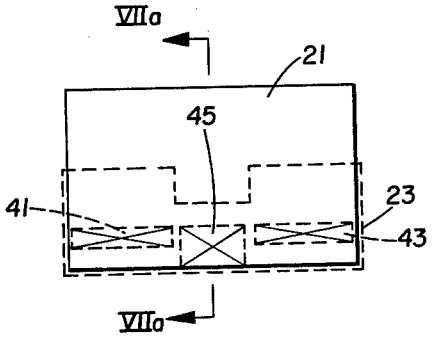
FIGS. 7 and 7*a* are schematic views of the car of FIG. 1 in a fourth operative position.
Figure 7A:
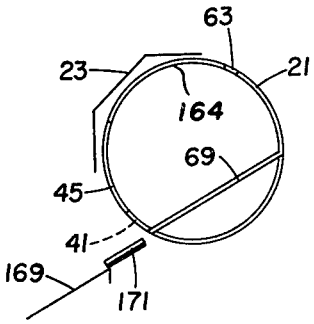

After the quenching operation, the water flow from the spary 167 is stopped, the cylindrical drum is rotated counterclockwise from the quench position of FIG. 6a to the position shown in FIG. 5a, as the coke quenching car 11 moves from the quenching station (not shown) to a coke wharf 169, shown in FIGS. 3 and 7a.

When the car 11 reaches the coke wharf, the motor 114 is activated to rotate the drum 21 further in a counterclockwise direction as shown in FIG. 3 and in FIGS. 4a–7a, a coke guide plate 171 is mounted angularly to the flat-bed frame 13 and the coke, discharging from the cylindrical drum 21, is directed by the coke guide plate 171 onto the surface of the coke wharf. After the coke has been discharged onto the coke wharf 169, motor 114 is activated again, the cylindrical drum 21 is rotated clockwise to the catch position, shown in FIGS. 2, 3, 4 and 4a and the sequence described herein is repeated at the next oven to be pushed.

From the foregoing description of one embodiment of the invention, those skilled in the art should recognize many important features and advantages of it. Because of the uniform loading, the coke quenching car 11 of the present invention can be a shorter car than conventional quenching cars.

The car 11 of the invention does not require movable covers as has been required for some conventional quenching cars.

Although the invention has been described herein with a certain degree of particularly it is understood that the present disclosure has been made only as an example and that the scope of the invention is defined by what is hereinafter claimed.

What is claimed is:

1. Apparatus for receiving and transporting hot coke pushed from a coking chamber of a coke oven battery comprising:

(a) a vehicle that is movable along the coke exit side of a coke oven battery, parallel to said battery;

(b) a rotatable tubular vessel having closed ends, a tubular shell and at least one opening in said tubular shell through which said hot coke passes into said vessel;

(c) means rotatably mounting said vessel on said vehicle arranged such that the axis of rotation of said vehicle is horizontal and parallel to the direction of movement of said vehicle;

(d) means for rotating said vessel, as mounted on said vehicle;

(e) means, within said vessel, disposed peripherally adjacent said at least one opening for supporting and leveling said coke;

(f) means incorporated into said vessel by which said hot coke, within said vessel, can be quenched;

(g) means, mounted to said vehicle, to prevent escape of dust and gases emanating from said hot coke within said vessel, forming a fixed fume hood over at least a portion of said vessel; and (h) means, mounted to said vessel, for collecting and conducting out of said vessel, dust and gases emanating from said hot coke and steam and particulate matter effluent from said quenching of said hot coke.

2. The invention described in claim 1 further comprising:

(a) another fume hood, positioned above said vessel, fixed to a coke guide that is movable along said coke exit side of said battery, parallel to said battery, and between said vehicle and said battery; and (b) a movable section of said fume hood that cooperates with said vessel and surrounds said at least one opening through which said hot coke passes into said vessel.

3. The invention described in claim 1 wherein said means for collecting and conducting is centered on one of said ends of said vessel and fixed thereto about said axis of rotation of said vessel.

4. The invention described in claim 1 wherein said means for rotating said vessel permits both clockwise and counterclockwise rotation of said vessel about said axis whereby said vessel can rotate firstly to level said coke within said vessel and secondly to bring said at least one opening to a position where said coke, supported on said means for supporting said coke, discharges from said vessel through said opening.

5. The invention described in claim 1 wherein said means incorporated into said vessel by which said hot coke can be quenched includes:

(a) at least one other opening, longitudinally spaced apart from said at least one opening, in said tubular shell of said vessel, through which a cooling fluid is flowed to cool said hot coke therein; and (b) at least one drain opening, circumferentially spaced apart from said at least one opening and said at least one other opening, in said tubular shell of said vessel, through which said cooling fluid can discharge after cooling said coke.

6. The invention described in claim 1 further comprising lining means fixed to the interior surface of said vessel.

7. The invention described in claim 6 wherein said lining means is spaced apart from said interior surface of said vessel.

8. The invention described in claim 7 wherein said lining means comprises plates having scarfed edges lying in adjacent overlapping relation along said scarfed edges.

9. A method of handling hot coke, utilizing apparatus for receiving and transporting hot coke pushed from a coking chamber of a coke oven battery comprising:

(a) a vehicle that is movable along the coke exit side of said battery, parallel to said battery;

(b) a rotatable tubular vessel having closed ends, a tubular shell and at least one opening in said tubular shell through which said hot coke passes into said vessel;

(c) means rotatably mounting said vessel on said vehicle arranged such that the axis of rotation of said vehicle is horizontal and parallel to the direction of movement of said vehicle;

(d) means for rotating said vessel, as mounted on said vehicle;

(e) means, within said vessel, disposed peripherally adjacent said at least one opening, for supporting said coke;

(f) means incorporated into said vessel by which said hot coke, within said vessel, can be quenched;

(g) means to prevent escape of dust and gases emanating from said hot coke as discharged into said vessel; and (h) means, mounted to said vessel, for collecting and conducting out of said vessel, dust and gases from said hot coke and steam and particulate matter effluent from said quenching of said hot coke;

which method comprises:

(a) aligning said apparatus transverse to the central axis of said coking chamber of said coke oven battery;

(b) discharging said hot coke from said coking chamber into said tubular vessel through said at least one opening while activating said means for collecting and conducting and engaging said means to prevent escape of dust and gases;

(c) rotating said tubular vessel through a limited arc to level said coke within said tubular vessel with said means for supporting said coke;

(d) moving said apparatus to a quenching station;

(e) quenching said coke;

(f) moving said apparatus to a coke wharf; and (g) rotating said tubular vessel through a limited arc whereby said means for supporting coke is positioned to discharge said coke onto said coke wharf through said at least one opening.

10. Apparatus for guiding hot coke pushed from a coking chamber of a coke oven battery and for receiving and transferring said hot coke to a quenching station where said hot coke is cooled and for transporting to and ejecting said hot coke, now cooled, onto a coke wharf, comprising:

(a) a coke guide, through which said hot coke passes, mounted on a structure that is movable along the coke exit side of a coke oven battery parallel and immediately adjacent to said battery, said coke guide having an end adjacent to and an end remote from said battery;

(b) a first fume hood fixed to said structure and surrounding the end of said coke guide which is remote from said battery;

(c) a first vehicle that is movable parallel to said battery along the coke exit side thereof, adjacent to said coke guide mounted on said structure, separated from said battery by the general width of said structure and said coke guide;

(d) a rotatable tubular vessel having closed ends, a tubular shell and at least one opening in said tubular shell through which said hot coke passes into said vessel and at least one other opening, longitudinally spaced apart from said at least one opening, in said tubular shell of said vessel, through which cooling fluid is flowed to quench said hot coke therein;

(e) means rotatably mounting said vessel on said first vehicle for rotation of said vessel about its central horizontal axis parallel to said battery;

(f) a movable section of said first fume hood surrounding said at least one opening and coacting with said tubular shell of said vessel whereby dust and gases emanating from said hot coke, through said at least one opening, as said hot coke passes into said vessel, are prevented from escaping to the ambient atmosphere;

(g) means, mounted to said first vehicle, to prevent escape of dust and gases emanating from said hot coke, through said at least one other opening, as said hot coke passes into said vessel, and through both said at least one opening and at least one other opening, after said hot coke is within said vessel, forming a fixed, second fume hood over a portion of said tubular shell of said vessel;

(h) means for rotating said vessel, as mounted on said first vehicle, about said axis in a clockwise and counterclockwise direction, operable to bring, concurrently, said at least one opening and said at least one other opening to a position completely beneath said second fume hood;

(i) means, within said vessel, disposed peripherally adjacent said at least one opening, for supporting said coke;

(j) at least one drain opening in said tubular shell, circumferentially spaced apart from said at least one opening and said at least one other opening, through which said cooling fluid can discharge after cooling said coke, (k) means for collecting and conducting out of said vessel, dust and gases emanating from said hot coke and particulate matter effluent from said quenching of said hot coke, positioned on one of said ends of said tubular shell, forming the closure of one of said closed ends of said vessel, and fixed to said first vehicle about said axis of said vessel;

(l) lining means, fixed to the interior surfaces of said vessel, spaced apart from said interior surface of said vessel;

(m) means for raising and lowering said movable section of said first fume hood;

(n) a second vehicle coupled to said first vehicle, adapted to clean the flow, emanating and effluent from said coke, of dust, gases and particulate matter; and (o) conduit means, communicating with said collecting and conducting means, for carrying said flow, emanating and effluent from said coke, containing dust, gases and particulate matter, to said second vehicle wherein said flow is cleaned of said dust, gases and particulate matter.

11. The invention described in claim 10 further comprising a grating fixed within each said drain opening.

12. The invention described in claim 10 wherein said lining means comprises a plurality of plates having scarfed adjacent edges, said edges which overlap each other.

13. The invention described in claim 10 further comprising means pivotally mounted to said coke guide structure and coacting with said coke guide and said vessel for distributing hot coke into said vessel.

14. The invention described in claim 10 wherein said means for supporting said coke in said vessel comprises a planar surface disposed therein in geometric chord-like manner with supporting structure connected to the interior surfaces of said vessel.

15. The invention described in claim 10 wherein said means for rotating said vessel comprises:

(a) a bull gear mounted axially to said vessel; and (b) a powered pinion drivingly mated with said bull gear and mounted on said first vehicle.

16. The invention described in claim 10 further comprising means, mounted to said first vehicle, for guiding discharging coke away from said first vehicle toward said coke wharf.

17. The invention described in claim 10 further comprising:

(a) a pair of trucks mounted to the underside of said first vehicle;

(b) a pair of trucks mounted to the underside of said second vehicle; and (c) a plurality of rails upon which said trucks render said first vehicle and said second vehicle movable.

18. The invention described in claim 10 further comprising means to concurrently move said first vehicle and said second vehicle.

19. A method of handling hot coke, utilizing apparatus for guiding hot coke pushed from coking chamber of a coke oven battery and for receiving and transferring said hot coke to a quenching station where said hot coke is cooled and for transporting to and ejecting said hot coke, now cooled, onto a coke wharf, comprising:

(a) a coke guide, through which said hot coke passes, mounted on a structure that is movable along the coke exit side of a coke oven battery parallel and immediately adjacent to said battery, said coke guide having an end adjacent to and an end remote from said battery;

(b) a first fume hood fixed to said structure and surrounding the end of said coke guide which is remote from said battery;

(c) a first vehicle that is movable parallel to said battery along the coke exit side thereof, adjacent to said coke guide mounted on said structure, separated from said battery by the general width of said structure and said coke guide;

(d) a rotatable tubular vessel having closed ends, a tubular shell and at least one opening in said tubular shell through which said hot coke passes into said vessel and at least one other opening, longitudinally spaced apart from said at least one opening, in said tubular shell of said vessel, through which cooling fluid is flowed to quench said coke therein;

(e) means rotatably mounting said vessel on said first vehicle for rotation of said vessel about its central horizontal axis parallel to said battery;

(f) a movable section of said first fume hood surrounding said at least one opening and coacting with said tubular shell of said vessel whereby dust and gases emanating from said hot coke, through said at least one opening, as said hot coke passes into said vessel, are prevented from escaping to the ambient atmosphere;

(g) means, mounted to said first vehicle, to prevent escape of dust and gases emanating from said hot coke, through said at least one other opening, as said hot coke passes into said vessel, and through both said at least one opening and at least one other opening, after said hot coke is within said vessel, forming a fixed, second fume hood over a portion of said tubular shell of said vessel;

(h) means for rotating said vessel, as mounted on said first vehicle, about said axis, operable to bring, concurrently, said at least one opening and said at least one other opening to a position completely beneath said second fume hood;

(i) means, within said vessel, disposed peripherally adjacent said at least one opening, for supporting said coke;

(j) at least one drain opening in said tubular shell, circumferentially spaced apart from said at least one opening and said at least one other opening, through which said cooling fluid can discharge after cooling said coke;

(k) means for collecting and conducting out of said vessel, dust and gases emanating from said hot coke, and particulate matter effluent from said quenching of said hot coke, positioned on one of said ends of said tubular shell, forming the closure of one of said closed ends of said vessel, and fired to said first vehicle about said axis of said vessel;

(l) lining means, fixed to the interior surface of said vessel, spaced apart from said interior surface of said vessel;

(m) means for raising and lowering said movable section of said first fume hood;

(n) a second vehicle coupled to said first vehicle, adapted to clean the flow, emanating and effluent from said coke, containing dust, gases and particulate matter, to said second vehicle wherein said flow is cleaned of said dust, gases and particulate matter;

which method comprises:

(a) spotting said first vehicle at said coking chamber;

(b) interposing said coke guide between said coking chamber and said first vehicle;

(c) rotating said tubular vessel to align said at least one opening, in said tubular shell, to permit said hot coke to pass into said tubular shell;

(d) aligning said coke guide and said movable section of said first fume hood with said coking chamber to allow the passage of coke therethrough into said first vehicle;

(e) pushing said hot coke from said coking chamber, through said coke guide and said first fume hood into said tubular vessel through said at least one opening;

(f) activating said means for collecting and conducting;

(g) rotating said tubular vessel to bring said at least one opening and said at least one other opening under said second fixed fume hood;

(h) collecting and conducting dust and gases to said second vehicle;

(i) moving said first and said second vehicle to said quenching station;

(j) rotating said tubular vessel to align said at least one opening and said at least one other opening with the quenching units of said quenching station;

(k) spraying or streaming water from said quenching units onto said hot coke, thus forming quenched coke;

(l) draining said water through said at least one drain opening;

(m) rotating said tubular vessel to bring said at least one opening and said at least one other opening under said second fixed fume hood;

(n) moving said first and said second vehicles concurrently to said coke wharf;

(o) rotating said tubular vessel to position said at least one opening and said at least one other opening above, and adjacent to, said coke wharf and, thus, aligning said means for supporting said coke with said coke wharf to form an inclined-plane parallel extension of said coke wharf; and (p) cascading said coke from said tubular vessel, down said means for supporting said coke, through said at least one opening and said at least one other opening, onto said coke wharf.

* * * * *